US005190302A

United States Patent [19]

Trotta

[11] Patent Number: 5,190,302

[45] Date of Patent: Mar. 2, 1993

[54] TRANSPORTABLE COMPONENT STAND

[75] Inventor: Frank Trotta, Maplewood, N.J.

[73] Assignee: Electronic Voting Systems, Inc., New York, N.Y.

[21] Appl. No.: 782,744

[22] Filed: Oct. 17, 1991

Related U.S. Application Data

[63] Continuation of Ser. No. 518,164, May 30, 1990, abandoned.

[51] Int. Cl.[5] ..... B62B 3/02

[52] U.S. Cl. ..... 280/35; 248/125; 248/129; 248/917; 248/919; 280/47.34; 312/22

[58] Field of Search ..... 280/35, 651, 652, 659, 280/47.19, 47.18, 47.26, 47.34, 47.35; 248/129, 125, 917, 919; 108/144; 211/207; 312/22, 22.3; 52/36, 63; 235/50 R, 52

[56] References Cited

U.S. PATENT DOCUMENTS

| | | | |
|---|---|---|---|
| D. 282,375 | 1/1986 | Dolson | D18/6 |
| 3,170,710 | 2/1965 | Rachman | 312/223 |
| 3,181,785 | 5/1965 | Laws et al. | 235/52 |
| 3,286,918 | 11/1966 | Coyle | 235/50 |
| 3,315,621 | 4/1967 | Szymber | 108/144 |
| 3,333,766 | 8/1967 | Crossland et al. | 235/50 |
| 3,389,947 | 6/1968 | Kelley et al. | 312/258 |
| 3,620,587 | 11/1971 | Ahmann | 312/223 |
| 3,652,012 | 3/1972 | Harris et al. | 235/50 |
| 4,377,367 | 3/1983 | Smith | 414/545 |
| 4,440,457 | 4/1984 | Fogelman et al. | 312/223 |
| 4,445,731 | 5/1984 | Ahmann | 312/223 |
| 4,451,728 | 5/1984 | McKay et al. | 235/50 R |
| 4,510,378 | 4/1985 | Dolson | 235/50 R |
| 4,690,417 | 9/1987 | Betts et al. | 280/47.34 |
| 4,718,741 | 1/1988 | Nichoalds | 312/223 |
| 4,848,710 | 7/1989 | Newman | 248/125 |

FOREIGN PATENT DOCUMENTS

| | | | |
|---|---|---|---|
| 2902803 | 7/1980 | Fed. Rep. of Germany . | |
| 3619481 | 12/1987 | Fed. Rep. of Germany | 108/144 |
| 2567378 | 1/1986 | France | 248/917 |
| 2613514 | 10/1988 | France . | |
| 2171597 | 9/1986 | United Kingdom | 108/144 |

*Primary Examiner*—Eric D. Culbreth

*Attorney, Agent, or Firm*—Hedman, Gibson & Costigan

[57] ABSTRACT

A transportable component stand for storage and use of the contained components in various locations having wheels and a handle for ease of movement. The height of the components and the angle of at least some of the components can be varied for use by various persons. The transportable stand further includes locking panels to prevent unauthorized access and storage spaces for concealing the power cord, as well as associated hardware and curtains for creating an enclosure, i.e., when used as a voting booth.

14 Claims, 7 Drawing Sheets

TRANSPORTABLE COMPONENT STAND

This application is a continuation of U.S. patent application Ser. No. 07/518,164, filed on May 30, 1990, now abandoned.

FIELD OF THE INVENTION

The present invention relates to a transportable device for supporting components which can be moved to a specific location for use of said components.

BACKGROUND OF THE INVENTION

The public has come to rely on the use of various electronic components for innumerable functions in society. However, mobility and physical set-up of the components have been a problem when the components are cumbersome and need special supports to be properly positioned for various uses by various persons.

Therefore, the objects of the present invention are to provide means for storage, transport and use of electronic components which is easily movable and which can be adjusted for various uses by various persons.

SUMMARY OF THE INVENTION

The objects of the present invention are realized by a transportable component stand comprising means for mounting one or more components for user interaction, means for selectively varying component height and means for physical movement of the device.

The means for mounting the components include a component module, in which the components are mounted, and which is removable from the transport device for storage and/or use of the components apart from the transportable stand. The component module, however, as contemplated herein, is left in the stand for use of the mounted components while on the transportable stand, allowing the components to be moved to a designated location and used without additonal support means.

The means for mounting the components may also include means for tilting one or more of the components to the angle best suited to the specific user.

Means for selectively varying component height allows adjustment of the components on the transportable stand from a low position to a high position enabling the stand to function for a variety of different uses. The means for varying component height associated with the stand preferably comprises a crank or jack or ratchet-type elevating means wherein the height of the components can be adjusted without removal of the components themselves.

Means for physical movement is also included, i.e., wheels, casters, rollers, etc., or combinations thereof. The means are enhanced by one or more handles to help maneuver the transportable component stand.

The means for physical movement allows easy transportation of the stand to a designated location for use of the components. This feature is particularly important when the components supported in the stand can include electronic voting means, children's educational computers, information computers and the like, which preferably can be relocated depending on need.

Storage compartments can also be incorporated into the stand as desired for specific uses. For instance, use as a voting booth may include a compartment for concealing enclosure hardware, i.e., a curtain support structure, as well as a compartment for storing the privacy curtains. Also, a cover for the back of the component compartment, optionally including a locking means, may be desirable to limit access to the back of the components and to consolidate the power needs of the components into a single power supply cord. Similarly, a locking cover for the front of the components can be included to prohibit unauthorized use.

DESCRIPTION OF THE DRAWINGS

The following figures, in which like reference characters indicate like parts, merely illustrate an embodiment of the present invention and are not intended to limit the invention in any manner whatsoever.

DESCRIPTION OF THE PREFERRED EMBODIMENT

Figure 1:
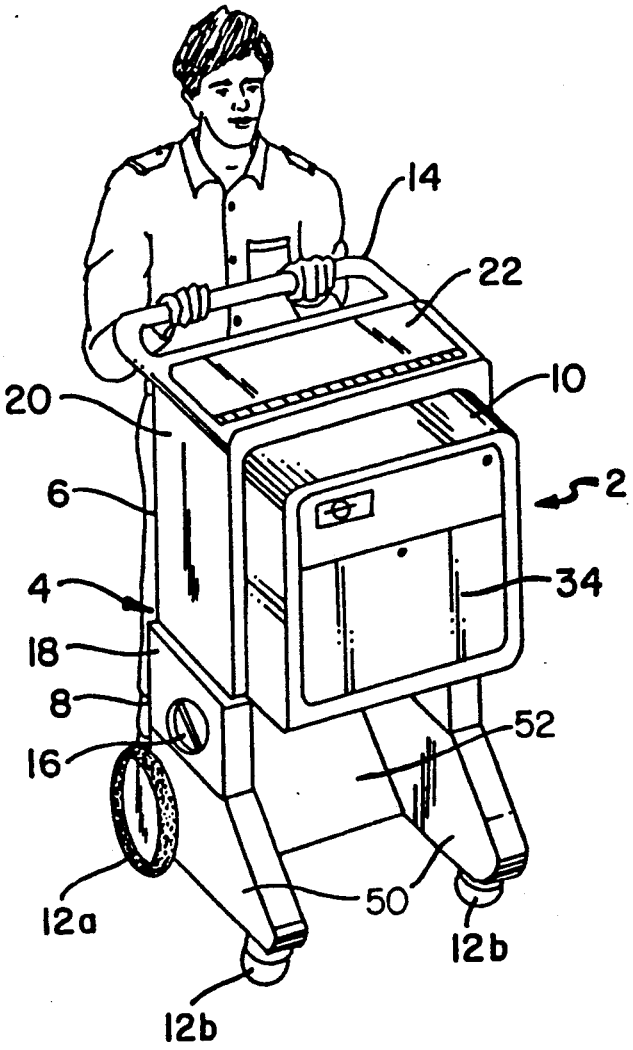
FIG. 1 is a perspective view of the transportable stand of the present invention being moved with the components in the low position.

As shown in the FIGURES, and specifically FIG. 1, the transportable component stand 2 of the present invention is comprised of a frame 4 including an upper frame member 6 and a lower frame member 8. The components are shown located within a component module 10 which is attached to the upper frame member 6. Wheels **12*a* and 12*b* are attached to the lower frame member 8 for mobility and handle means 14 are included on the upper frame member 6 to facilitate maneuverability. An elevating means, such as a crank 16, is located on one of the sides of the lower frame member 8 to raise and lower the upper frame member 6, including the component module 10**, to the desired height.

The frame 4 can be made of any suitable materials including metals, alloys, wood, plastic, combinations of these, or other materials able to achieve the intended use, with a metal being most preferred.

For transporting the stand 2, as shown in FIG. 1, it is preferred that the upper frame member 6 is in the low position to lower the center of gravity and avoid toppling. Although a different number of wheels can be used, the preferred stand 2 has four wheels **12*a* and 12*b* on the bottom of the lower frame member 8 to maximize maneuverability and stability. As shown in the FIGURES, the back wheels 12*a* are of larger size, extend rearwardly out from the back plane of the unit 2, to facilitate traversing stepped changes in elevation and are fixed laterally. The front wheels 12*b*** are preferably swivel or caster type to facilitate turning. This wheel configuration, although not essential to the invention, has been found to achieve good results for mobility, maneuverability and stability.

Stability is also improved by the placement of the wheels at the corners of a square, the size of which is dependant on the intended use. It has been found that, for use with a computer system including monitor, drive and keyboard, a distance of about 24" between the wheels on any side is appropriate to combine stability and efficient use of space.

Once the stand 2 is positioned into place, the wheels 12 are locked or fixed to avoid inadvertant movement of the stand. Alternatives may include retractable wheels to allow the stand 2 to rest on the lower frame member 8 or extensions thereof, i.e., posts, attached to the lower member 8.

The lower frame member 8 is recessed between the front wheels **12*b* to allow a wheelchair, or the user's legs when seated on a standard chair, to rest under the component module 10 and place the user within reach of the components. The tops of the sides 18 of the lower frame member 8 have female openings substantially the size and shape of the bottom of the sides 20 of the upper frame member 6, adapted to securely receive the bottom of the male sides 20 in inserted relationship. Thus, the upper frame member 6 is engaged and securely held by the lower frame member 6**.

A crank 16 is located on the lower frame member 8 which internally cooperates with the inserted portion of the side 20 of the upper frame member 6 to raise or lower the upper frame member 6 on the lower frame member 8. The crank 16 need only be on one side of the lower frame member 8 with means to level and secure the upper frame member 6 cooperating with the other side 20, by means of cooperating gears.

The upper frame member 6, which supports the component module 10 is enclosed on its sides 20 in the present embodiment, the bottom of said sides 20 fitting into the opening 18 of the lower frame member 8 (described above). The front and back of the upper frame member 6 are open to accept the component module 10 with means for mounting the component module 10 within the upper frame member 6. A handle 14 is included on the back of the frame 4 at the top of the upper frame member 6 to improve maneuverability during transportation. Of course, the handle can be any handle means including two protruding handles, one on each side of the back of the frame 4 or protruding from planes 20, rather than the single handle shown.

Figure 3:
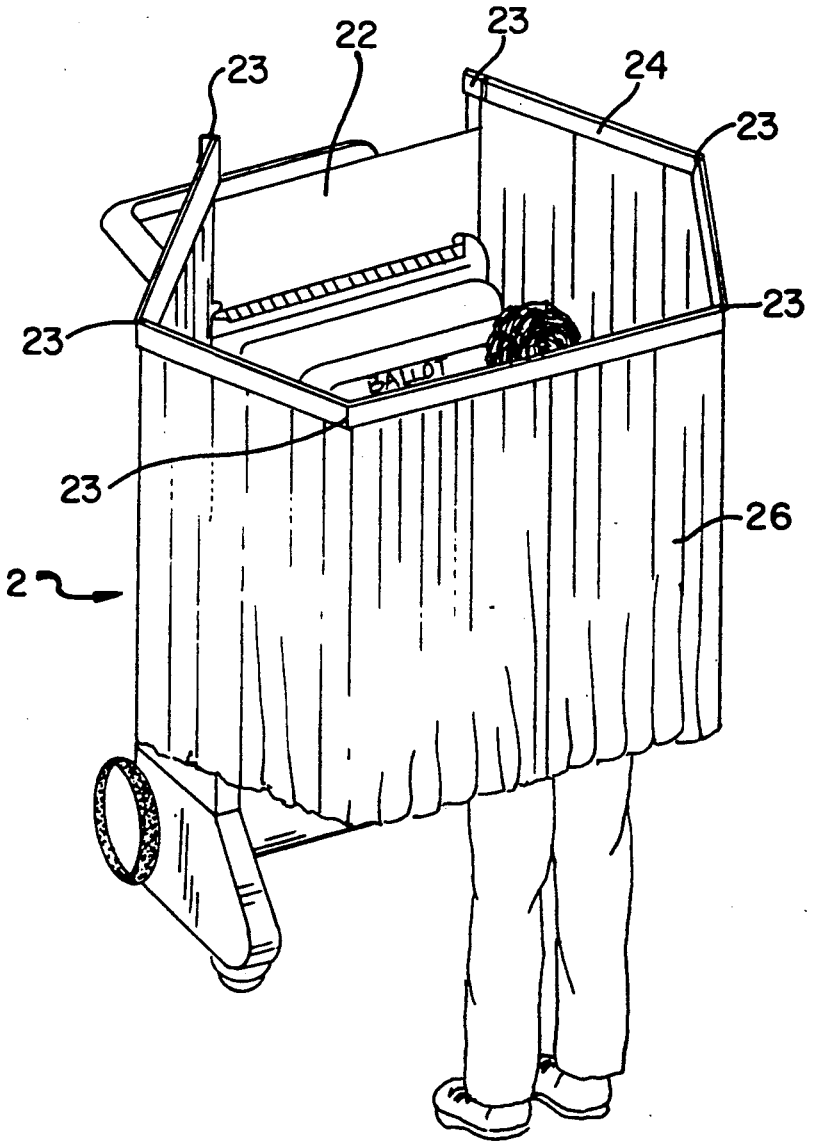
FIG. 3 is a perspective view of the stand used as a voting enclosure in the high position.

The top of the upper frame member 6 includes a top storage compartment closed by a hinged door 22. In its preferred embodiment, to permit use of the stand 2 for many functions, the top storage compartment houses an unfolding curtain support structure 24 for supporting a privacy curtain 26 adapted to enclose the component module 10 during use as a voting booth or at other times when privacy is desired (see FIG. 3).

The curtain support structure 24 can be made of any material capable of supporting the privacy curtain 26, such as a metal or high strength plastic, or a combination of these. Hinges 23 are provided in the structure 24 to allow folding of the structure 24 into the top storage compartment and opening of the "doors" of the privacy curtain for entrance and exit. The hinges 23 are preferably stop hinges which limit the pivot motion of the sections of the structure.

The upper frame member 6 can employ any means to support components desired for use with the transportable stand 2, including shelves, a rack-type system, side mounts, etc.

In any event, the components or component module 10, or means for support, whichever is lower, cannot be below the point on the upper frame member sides 20 which fit into the lower frame member sides 18 when the upper frame member 6 is in its lowest position. This is necessary to assure that the upper frame member 6 can be moved into its lowest position without interference.

Figure 7:
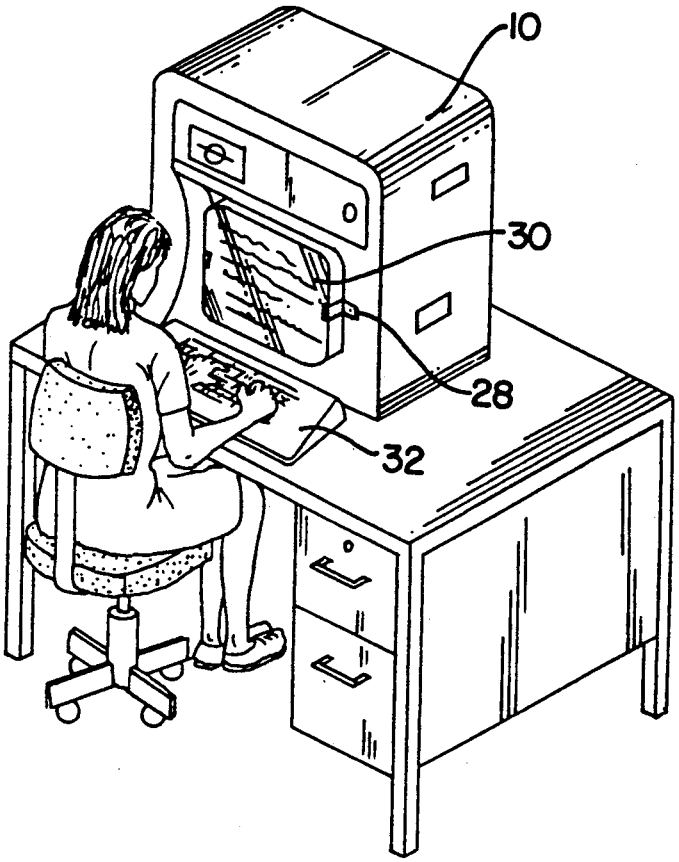
FIG. 7 is a perspective view of the component module removed from the transportable stand being used at a desk.

Generally, the desired components are contemplated to include a touch input screen or monitor, a computer drive system and possibly a keyboard for user interaction. Other possible components may include a sound or video system. Preferably, however, the components are placed in a component module 10 which is engaged by the upper frame member 6 by engagement means including bolts, hooks and shelves. The component module 10 containing the components is preferably removable from the frame 4 for use of the component system apart from the transportable stand 2, as shown in FIG. 7.

The module 10 includes support means for a monitor 30 to be placed on/or attached thereto. Said support means can be tilted to the appropriate angle by the use of levers 28 which engage the support means. This arrangement allows the monitor 30 to be tilted or angled to the proper alignment for use by the individual user. The lever 28 may be an assembly which allows the monitor 30 to be locked into set angles and require deliberate activation of a lever lock to change angle. This locking feature would immobilize the monitor 30 thereby facilitating touch inputs to the monitoring screen. The optional keyboard 32 cooperates with the levered support means to provide a relatively constant relationship between the angle of the screen 30 and the keyboard 32 when the screen 30 is tilted.

An advantage of the component module 10 is the ability to close and lock the components therein, preventing theft or unauthorized use, through the use of a locking cover 34. The locking cover 34 attaches to the module 10, or sides of the upper frame member 6, to lock all or merely some of the components.

Another advantage of the component module 10 is the ability to retain different component modules 10 for different components, being interchangeable in the frame 4. For example in a school used as a polling place, the same frame 4 can be used with computer educational modules for student's use which are replaceable with voting modules for elections.

Figure 2:
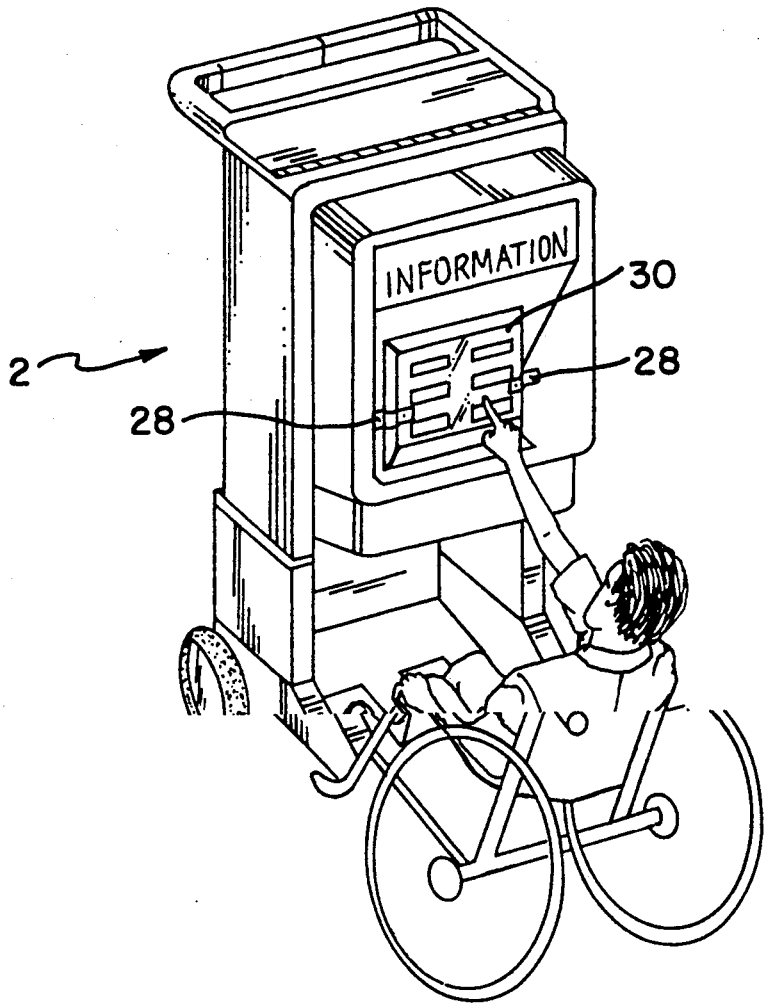
FIG. 2 is a perspective view of the stand used as an information kiosk.
Figure 4:
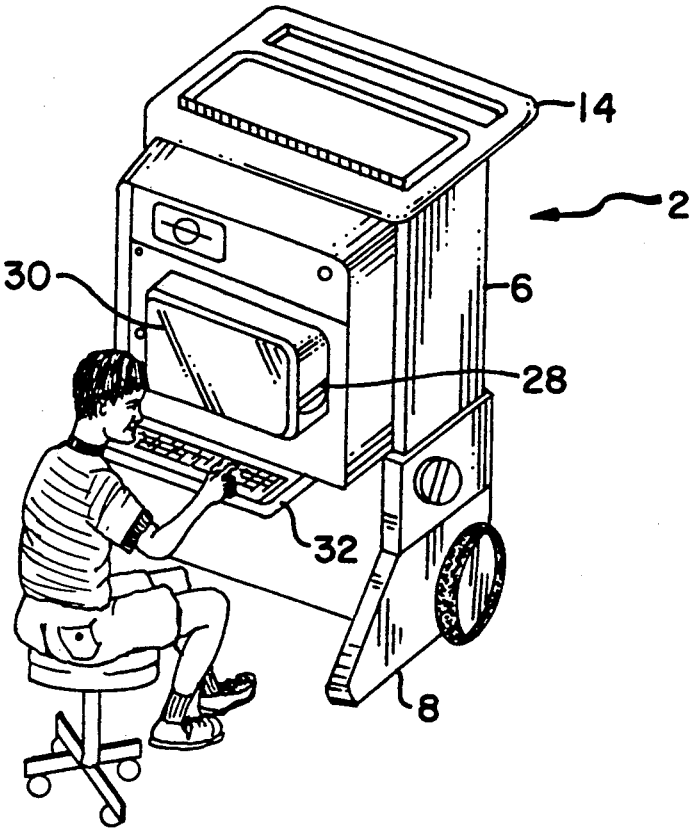
FIG. 4 is a perspective view of the stand being used as a portable child education station in the low position.
Figure 5:
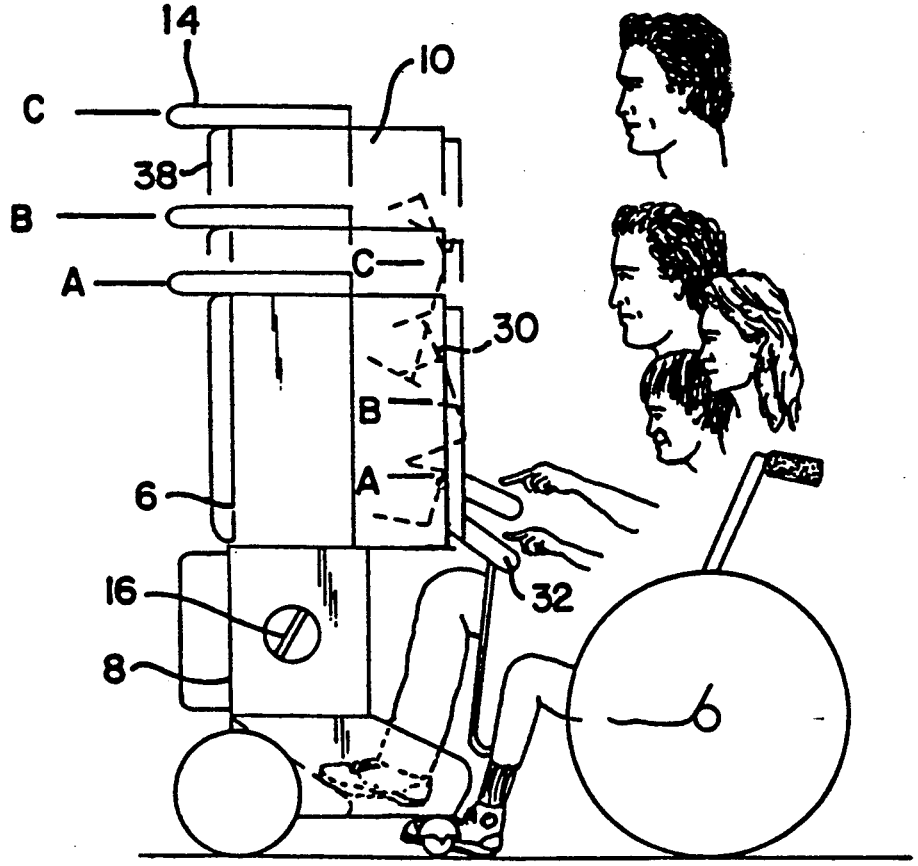
FIG. 5 is a side elevational view of the stand at its variable low, medium and high positions.

As shown in FIG. 5, the height of the upper frame member 6 is adjustable from a low position through to a high position, depending on the desired use, by rotation of a crank 16 which cooperates with a ratchet or gear train. When used with children's educational components (shown in FIG. 4), the stand 2 is in its low configuration, designated as "A" in FIG. 5 and being approximately 52" from the floor to the top of the upper frame member 6. When used as an information kiosk, shown in FIG. 2, the stand 2 can be in its medium configuration, designated as "B" and being approximately 57" to allow use by sitting adults or persons seated in wheelchairs. The high position, designated as "C" and being approximately 66" from the floor to the top of the upper frame member 6, can be used for a voting booth or the like when standing adults are contemplated utilizing the components.

The mean height of the components on the stand is generally about 15–18 inches below the height of the top of the upper frame member 6. The tilting means actuated by the levers 28, described above, provide for adjustment of the angle of the screen 30 to the specific height of the user.

Figure 6A:
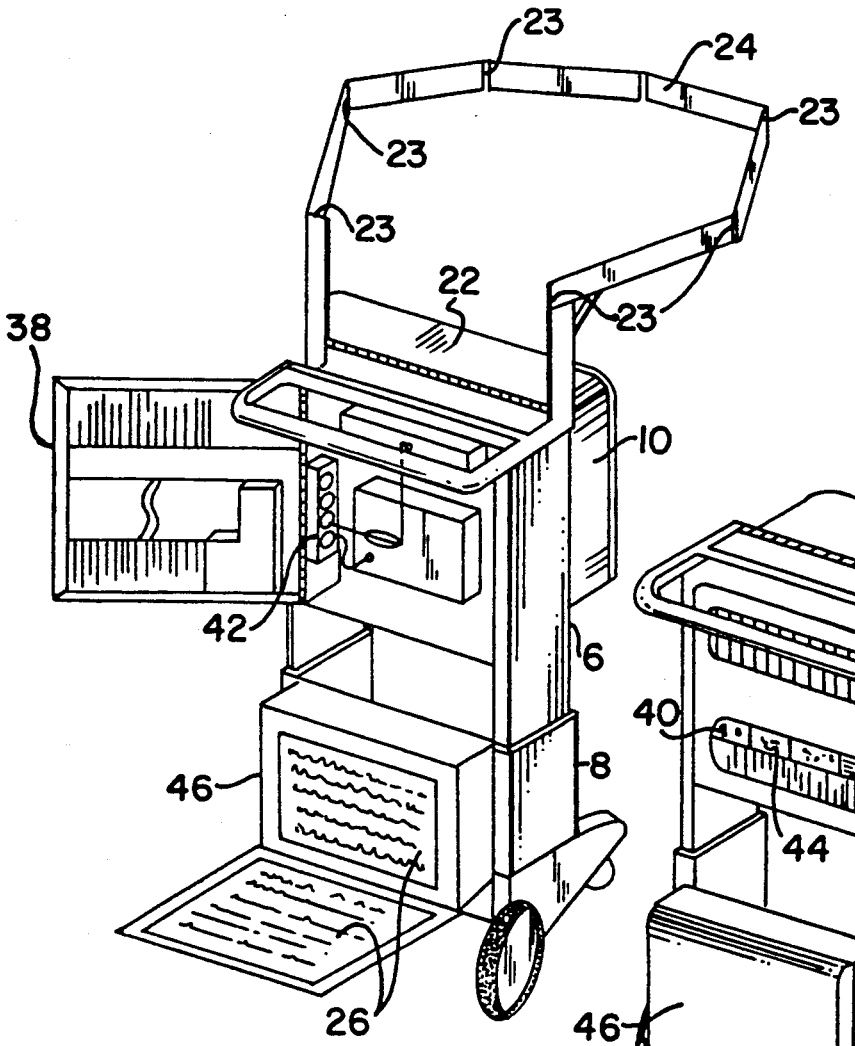
FIG. 6A is a perspective view of the back of the portable stand in its open configurations.
Figure 6B:
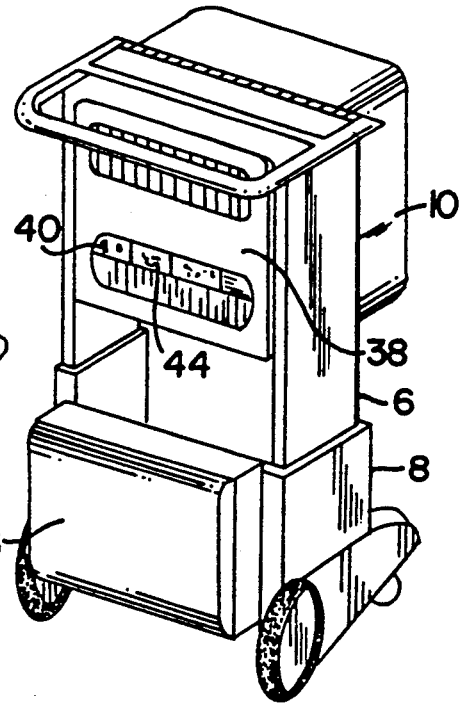
FIG. 6B is a perspective view of the back of the portable stand in its closed configuration.

The component module 10 is also preferred wherein the back of components contained therein are not exposed. As shown in FIG. 6, a back cover 38 cooperates with the component module 10 to enclose the components. The back cover 38 preferably includes a power switch 40 to control power to an internal power outlet 42 to which the components are connected. A power cord compartment 44 contains the power cord to access a wall outlet, providing power to the components contained in the component module 10. Vents and a small electric fan are incorporated into the back cover 38 to control the operating temperature of the enclosed component module compartment.

The back cover 38 also contains a compartment for a keyboard. An access panel in the outside surface of the back cover 38 allows access to a portion of the keyboard which is used to reset computer components when used in a voting configuration.

Another closable compartment 46, shown in FIG. 6, can optionally be included on a cross member on the back of the lower frame member 8 to provide additional storage. Shown in FIG. 6, the compartment 46 contains the privacy curtains 26 employed when the stand 2 is adapted for use as a voting booth.

Obvious variations of the above-identified invention will make themselves apparant to those of ordinary skill in the art and are intended to fall within the spirit and scope of the present invention, limited only by the appended claims.

I claim:

1. A transportable stand for use and storage of components for user interaction comprising an upper frame member interacting with a lower frame member, the upper and lower frame members each having two vertical side members being essentially parallel to each other at opposite sides of the stand, the side members having top portions and bottom portions, wherein the bottom portions of the side members of the upper frame member engage the top portions of the side members of the lower frame member and the bottom portion of the side members of the lower frame member further comprise substantially parallel base members which extend from front to back, the two side members of the lower frame member being attached by a cross-member having a compartment thereon wherein a recess in the front of the lower frame member is defined by the cross member in the back and the parallel said members in the front of the lower frame member to allow a user's legs when seated to rest under components on said stand, and further wherein the upper frame member includes handle means and has a component module with removable covers and components for user interaction located therein mounted on said upper frame member, said upper frame member being capable of being raised and lowered on the lower frame member by means for selectively varying component height relative to a floor on which the stand is located for use int he sitting or standing position and means for enabling movement of the stand comprising wheels attached to the base members of the lower frame member.

2. The transportable stand of claim 1 wherein the component module includes support means for at least one of the components including means for the user to change the angle of the component.

3. The transportable stand of claim 1 wherein the component module further comprises a front cover over at least one of the components having locking means associated therewith.

4. The transportable stand of claim 1 wherein the component module further comprises a back cover.

5. The transportable stand of claim 4 wherein the back cover of the component module includes a power supply cord and power control.

6. The transportable stand of claim 4 wherein the back cover further comprises locking means to prohibit unauthorized access.

7. The transportable stand of claim 1 further comprising curtain support structure means on which a privacy curtain is hung to provide privacy to the user of the components.

8. The transportable stand of claim 7 wherein the means height of the components is variable from about 36" to about 60" from the floor.

9. The transportable stand of claim 1 wherein the means for selectively varying the height of the components is a crank.

10. The transportable stand of claim 1 further comprising one or more closeable storage compartments on at lest one of the frame members.

11. The transportable stand of claim 1 wherein the wheels attached to the lower frame member comprise four wheels, of which two wheels are attached at the back of the lower frame member and two wheels are attached to the front of the lower frame member.

12. The transportable stand of claim 11 wherein the wheels attached to the back of the lower frame member are laterally fixed.

13. The transportable stand of claim 11 wherein the wheels attached to the front of the lower frame member are 360° horizontally rotatable wheels, including wheels taken from the group consisting of swivel wheels and casters.

14. The transportable stand of claim 11 wherein the wheels attached to the back of the lower frame member are laterally fixed and the wheels attached to the front of the lower frame member are 360° horizontally rotatable.

* * * * *